United States Patent [19]

Schiel

[11] 4,234,382

[45] Nov. 18, 1980

[54] FORMER FOR A PAPER MACHINE

[75] Inventor: Christian Schiel, Heidenheim, Fed. Rep. of Germany

[73] Assignee: J. M. Voith GmbH, Fed. Rep. of Germany

[21] Appl. No.: 967,482

[22] Filed: Dec. 7, 1978

[30] Foreign Application Priority Data

Dec. 8, 1977 [DE] Fed. Rep. of Germany ..... 2754622

[51] Int. Cl.[3] ..... D21F 1/36; D21F 1/52

[52] U.S. Cl. ..... 162/263; 162/301; 162/304; 162/317; 162/318; 162/351; 162/364

[58] Field of Search ..... 162/263, 295, 301, 304, 162/317, 318, 351, 364, 133, 198, 203, 211, 214, 217

[56] References Cited

U.S. PATENT DOCUMENTS

| | | | |
|---|---|---|---|
| 2,473,269 | 6/1969 | Adams | 162/295 |
| 3,029,871 | 4/1962 | Hornbostel | 162/364 X |
| 3,455,780 | 7/1969 | Hazard, Jr. et al. | 162/301 X |
| 3,832,282 | 8/1974 | Parker | 162/301 |
| 3,876,498 | 4/1975 | Justus | 162/301 X |
| 3,935,061 | 1/1976 | Biornstad | 162/198 |
| 3,997,390 | 12/1976 | Kankaanpaa | 162/203 X |
| 4,124,441 | 11/1978 | Nykopp | 162/301 |

*Primary Examiner*—Richard V. Fisher
*Attorney, Agent, or Firm*—Ostrolenk, Faber, Gerb & Soffen

[57] ABSTRACT

A former for a paper machine: The paper machine includes a perforated forming cylinder and a suction device for drawing water inward through the perforations. An inner and an outer belt are wrapped around the forming cylinder. The outer belt meets the inner belt at the peripheral surface of the forming cylinder in a generally wedge-shaped inlet slot located at and upstream of the bottom of the forming cylinder. A pulp fiber suspension nozzle of a width that covers the axial length of the forming cylinder injects pulp into the inlet slot. A supporting device is provided at the inlet slot and includes a convexly curved surface, convexly curved around an axis generally parallel to the cylinder axis. The supporting device includes a concavely curved surface that follows the convexly curved surface downstream of the flow of pulp. A suction device communicates with the concavely curved surface beneath the outer belt. The outer belt rides over the convexly curved surface and down onto the concavely curved surface. The inner belt is a wire mesh. The outer belt is a felt strip.

28 Claims, 3 Drawing Figures

FORMER FOR A PAPER MACHINE

The invention relates to a former for a paper machine comprising a forming cylinder around the peripheral surface of which are wrapped two endless belts and further comprising a pulp or fiber suspension nozzle of the width of the forming cylinder and having an outlet opening that is directed into a wedge-shaped inlet slot which is defined between the two belts at the circumference of the forming cylinder.

BACKGROUND OF THE INVENTION

Numerous so-called twin-wire formers of the above described type are known. For example, see German Offenlegungsschriften Nos. 2 534 290; 2 248 454 and 2 442 925. Machines of this construction have recently become increasingly adapted for the use at high speeds. The basic principle is to maintain the outer belt under a given tension during its travel, thereby to produce in the portion of the periphery of the forming cylinder which is wrapped, a pressure in the normal direction which removes water from the injected fiber suspension or the web of fibers being formed.

Paper webs produced on such twin-wire formers frequently exhibit many defects. Often, the edges of the webs have smaller thickness than their central regions, the fibers may be undesirably aligned in their longitudinal direction, and/or the web appears flaky, fluffy or cloudy when one looks through it. Ideally, the web should have approximately the same strength in both its longitudinal and its transverse directions, should not appear cloudy when looked through and should have a constant thickness profile measured over its width.

SUMMARY OF THE INVENTION

The object of the present invention is to create a twin-wire former which is able to produce paper webs that have the desired properties with regard to the aforementioned features.

The present invention provides a former for a paper machine. The former comprise a rotatable forming cylinder. Around the surface of the cylinder extends an inner and an outer preferably endless belt. The outer belt is separated from the cylinder periphery at one region of the cylinder so as to define a generally wedge-shaped injection slot formed between the two belts at the periphery of the forming cylinder. There is a nozzle for pulp or fiber suspension, which nozzle has a width extending over the axial length of the forming cylinder, the nozzle has an outlet opening which is directed into the pulp injection slot. Most important, a supporting device that extends across the width of the machine is positioned downstream of the pulp nozzle and is associated with the outer belt in the pulp injection slot at the cylindrical surface of the forming cylinder. The supporting device has a supporting surface which is concave with respect to the belt in the direction of travel of the belt, i.e. around an axis parallel to the axis of the forming cylinder. In a preferred embodiment, upstream with respect to the flow of pulp from the pulp nozzle, the supporting device has a convex supporting surface that is convex with respect to the belt around an axis parallel to the cylinder axis.

The invention is based upon recognition of the following ideas. The aforementioned defects of paper webs that have been produced on twin-wire formers are due to the aforementioned squeezing action which is exerted between the two endless belts. The thinning of the paper web at its edges occurs because the pulp is forced toward the edge of the machine within the injection or inlet slot as a result of the squeezing action, and because a part of the pulp in the suspension in this way leaves the injection or inlet slot. The cloudiness is also caused by the squeezing action. The jet of pulp which emerges from the pulp nozzle is impounded thereby, leading to flocculation. As a counter-measure against the flocculation, the pulp nozzle has up to now frequently imparted a higher velocity to the pulp than the velocity of the web-forming belts. However, this has led to the undesired longitudinal orientation of the fibers in the paper web.

The following results are obtained by using the invention. Only the impact surface of the concave supporting surface serves in general to support the outer belt. This means that at other places, the outer belt no longer rests on the supporting surface. It thus travels "hollow" here. A negative pressure is established within the wedge-shaped hollow space which is formed by the outer belt and the part of the supporting surface that is not contacted by the belt, as a result of a pumping action of the belt. The belt endeavors to empty the hollow space of air or of liquid which has penetrated. More air or liquid is removed from the hollow space than can be drawn into it laterally. The negative pressure developed in the hollow space is thus opposed to the drainage pressure prevailing between the two belts. This means that the drainage proceeds more gently in the very first part of the drainage region and that the aforementioned detrimental effects of impounding, flocculation, or thinning of the edges of the web no longer occur. The inward flow of air in the edge regions of the belts causes the outer belt to come closer to the inner belt at the edges than in the central region. As a result, the gap present between the two belts, through which the suspension could emerge laterally, is reduced or even entirely closed.

Various embodiments of the invention are possible. In principle, the aforementioned effect of the invention will be more evident the less permeable the outer belt is. If the outer belt is a wire screen and therefore very permeable, water will initially flow out of the suspension through the wire screen. Then, however, a layer of fibers deposits on the wire screen, obstructing the flow of the water through it. This in its turn leads to a pressure gradient towards the outside so that the wire screen approaches the concave guide surface. However, in a preferred embodiment of the invention, the outer belt may also consist of felt, which is inherently substantially less permeable to water than a wire screen. Furthermore, after the formation of the web, this felt can be used directly as a web-guiding belt. It can carry the web of paper along with it and conduct it, for instance, through a subsequent press. Other combinations are also conceivable. For instance, the inner belt may be of felt and the outer belt of wire, both belts may be of felt, or both may be of wire.

The dewatering or draining of the web can be effected by the forming cylinder if it has a cylindrical surface which is drilled or otherwise provided with openings. Suction zones for drawing liquid through the openings can then be provided in known manner inside the cylinder. However, the invention can also be applied to a forming cylinder which does not have such openings in its peripheral cylindrical wall. Water removal through the concave guide surface is also possible if the guide surface is provided with appropriate water discharge channels.

Water discharge can be controlled by the vacuum in the water discharge zone. In the injection or inlet slot, the concave supporting surface is arranged so as to converge toward the forming cylinder, corresponding to the removal of water in this region. When the drainage vacuum and the convergence between the forming cylinder and the supporting surface are optimally set, no positive pressure is present in the gap between the belts and the differences in speed between expelled pulp and the travelling belts particularly the outer belt, can be reduced or eliminated. Lateral squeezing out of pulp is thereby effectively countered.

The convergence between the supporting surface and the forming cylinder can also be made somewhat greater so that at the end of the supporting surface between the belts, there prevails approximately the same positive pressure as is produced in the adjoining zone as a result of the tension of the outer belt.

It is advisable to arrange the above mentioned supporting surface of convex curvature in front of or upstream of the concave supporting surface and particularly to arrange the convexly curved supporting surface in the region of impact of the pulp emitted from the pulp nozzle. This serves the following purposes: (a) It seals off the space between the outer belt and the concave portion of the supporting surface on the outlet side, which is important in high speed operation. (b) As a result of the preferably small radius of curvature of the convexly curved supporting surface, the jet of pulp can be applied to the outer web without any great disturbance and without inclusions of air. (c) The outlet from the pulp nozzle can be brought very close to the web-forming zone and the well-deflocculated suspension which emerges from the pulp nozzle can be fixed within a very short time before the fibers flocculate together.

By providing a convex first section of a supporting surface succeeded by a second concave section, an optimum formation of web is obtained between two belts. If the concave supporting surface were not present, then a sudden opposing damming would result when the two belts are brought together, with all the detrimental consequences thereof. If the convex initial supporting surface were not arranged before the concave supporting surface, it would not be possible to bring a pulp nozzle with an adjustable lip close to the web-forming zone which is necessary in order to fix the suspension in the well-dispersed condition in which it leaves the pulp inlet.

The convexly curved initial supporting surface can directly adjoin the succeeding concavely curved supporting surface or it may be independent of it. The convexly curved supporting surface can also be developed as a roller, although in this case the radius can be made as small as is desired only in the case of very narrow machines.

Other objects and features of the invention will be noted from the following description of embodiments of the invention considered with the accompanying drawings.

DESCRIPTION OF THE PREFERRED EMBODIMENTS

Figure 1:
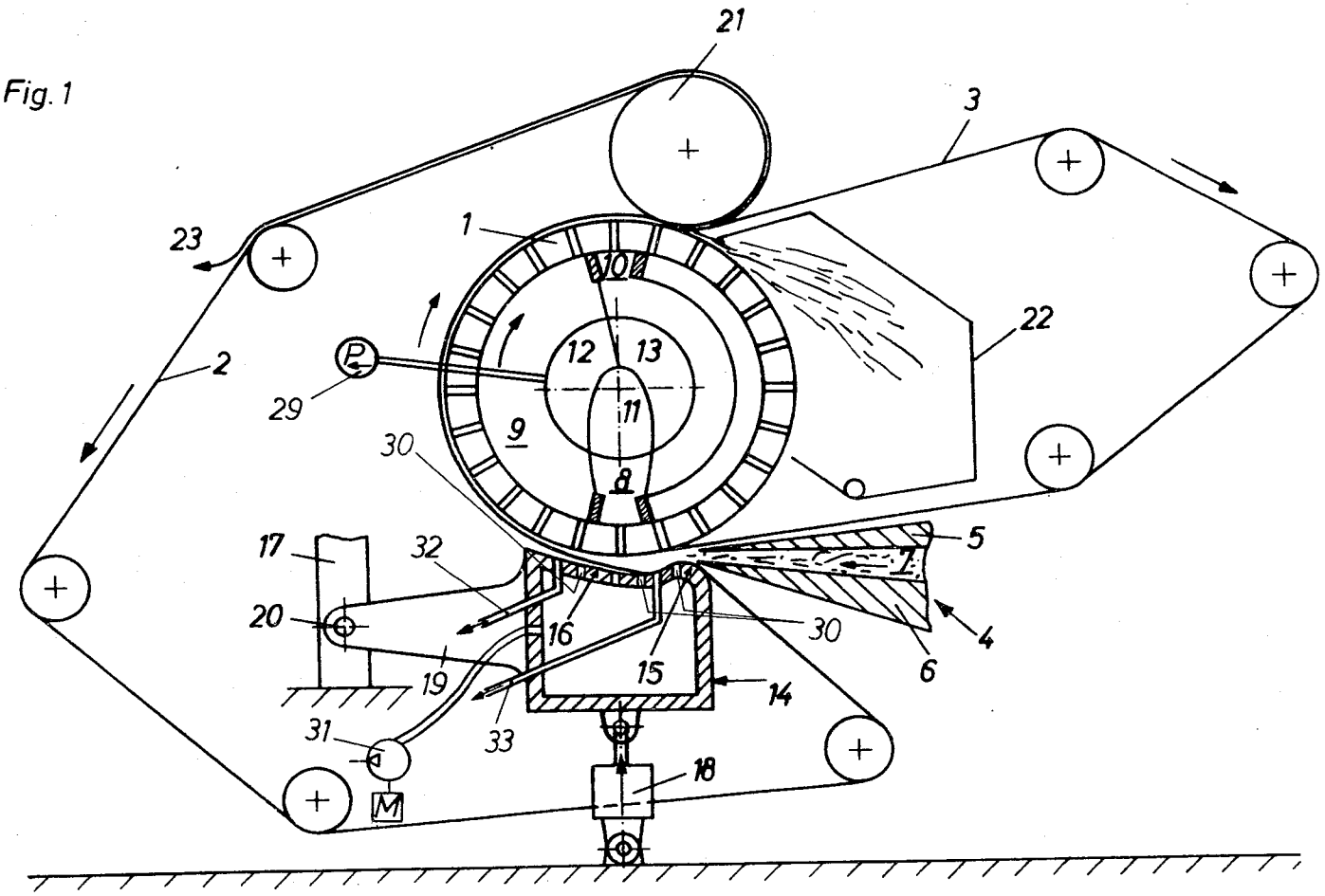
FIG. 1 is a partially cross-sectioned, elevational, schematic view of one embodiment of a former according to the invention.

In FIG. 1, the illustrated former is provided with a forming cylinder having a perforated peripheral cylindrical surface 1. Two belts each partially wrap around the periphery of the former, namely an outer felt belt 2 and an inner wire-screen belt 3. There is a pulp emitting nozzle 4, which extends the width of the forming cylinder 1. The nozzle 4 has an upper lip 5 and a lower lip 6. The nozzle conducts a jet 7 of pulp, which also is as wide as the forming cylinder 1, into the wedge-shaped injection or inlet slot, which is formed between the two belts 2 and 3 in the lower portion of the forming cylinder, just upstream of the bottom apex of the cylinder. Thus, upon rotation of the cylinder 1 accompanied by motion of the belts 2, 3, in the directions indicated by the arrows, a layer of pulp or fiber suspension is carried between the strips around the left-hand side of the cylinder in FIG. 1.

The forming cylinder 1 is equipped with suction zones 8, 9 and 10 in its interior. These suction zones 8, 9 and 10 are connected to suction means, pump 29, for instance, by channels 11, 12 and 13 that are located in the hollow journal of the forming cylinder.

A supporting device 14 is provided below the forming cylinder, just downstream of the outlet from the pulp nozzle 4 in the direction of travel of the pulp. This supporting device includes a supporting surface for the outer belt 2.

The supporting device 14 is comprised of a hollow cross bar which extends across the entire width of the machine and thus along the entire length of cylinder 1. The supporting device crossbar is pivotally supported on the machine frame 17 by opposed pivot levers 19 located at opposite sides of the machine. The cross bar can be moved into the operative position and can be swung out of that position by a pneumatic cylinder 18 connected to the cross bar. The supporting device 14 can also be rotated about its own longitudinal axis relative to the pivot levers 19. Adjustable end stops (not shown), resilient in nature, define the end limits of the motion of the crossbar. If desired, the pivot 20 of the lever 19 may be adjustable in height.

The support device 14 includes a convexly curved supporting surface 15 which is followed by a concavely curved supporting surface 16. These supporting surfaces face toward the outer belt. Their curvatures are around axes parallel to the axis of the forming cylinder 1. The convex surface 15 is located just after the outlet from nozzle 4 and the emitted pulp first impinges on the outer belt there. The curvature of the convex surface is sharper than that of the concave surface 16. The lower surface projects up above the concave surface, to define the illustrated sloping arrangement. The outer wire screen belt 2 does not rest against the entire length (viewed along the belts) of the concavely curved supporting surface 16. It does rest against the upstream region of that surface. But, in the central region and in the downstream region of the supporting surface 16, the outer screen belt 2 only comes close to the surface 16.

It is believed that the previously described shortcomings of paper webs produced on double belt formers may be traced to the compression effect referred to above which is exerted between the two endless belts. The thinning of the paper web at the edges thereof occurs because of this compressive effect. In the pulp inlet region, the paper material is urged toward the edges of the forming cylinder and a part of the pulp material, which is in suspension form, leaves the inlet gate in this way. The cloudy effect is also due to the compression. The jet of material emerging from the nozzle is thereby obstructed which leads to flocculation. Previous attempts have been made to counter this flocculation in which the suspension jet was provided with a higher speed than the web forming strips. However, this led to the undesired longitudinal orientation of the fibers in the paper web.

As already stated, the concavely curved support surface 16 serves generally only at its upstream end to support the outer belt 2, while in the central and downstream areas of the concave surface, there is a gap. Thus the belt runs "hollow". In the generally wedge like cavity which is defined by the outer belt and that part of the concave support surface 16 which is not touched by the outer belt, there occurs an underpressure, due to the motion of the belt. The outer belt endeavors to empty the aforementioned cavity (be this of air or of liquid which has penetrated in). More air or liquid is conveyed out of the cavity than can be sucked into it laterally. Thus, the normal pressure which prevails between the two belts 2, 3 is at least partially countered in the inlet region by the underpressure in this cavity. This means that the normal pressure between the belts 2 and 3 is lower in the very first part of the draining area over the surface 16 and the aforementioned disadvantageous effects, i.e. obstructions, flocculation and thinning of the edges can be substantially reduced. The flowing in of air in the edge region means that the outer belt is closer to the inner belt at the edges than at their centers. Consequently, the gap present between the two belts through which the fiber suspension of pulp material could escape laterally is reduced in size or even closed up entirely.

The convexly curved surface portion 15 has a number of functions. It seals off the area between the outer belt 2 and the concave part of the support surface 16 at the upstream end, which is important at high speeds. With a small radius of curvature for the surface 15, the pulp nozzle 4 can be applied to the outer belt 2 without much disturbance and without inclusions of air. The nozzle 4 can be brought quite close to the web forming zone and the deflocculated suspension emerging from the nozzle can be fixed in a very short length of time before flocculation of the pulp fibers might occur.

The juxtaposition of a convex first section 15 of a support surface and a second concave section 16 produces an optimum web formation between two belts. If the concave guide surface were not provided, a sudden counter-obstruction with all the disadvantageous consequences would occur when the two belts were brought together. If the convex guide surface were not provided, a pulp nozzle with an adjustable lip could not be brought as close to the web forming area as would be necessary in order to fix the suspension in the well dispersed state in which it leaves the nozzle.

There is a guide roller 21 above the forming cylinder 1. The roller 21 can be developed as a suction roller (not shown). The roller 21 can be arranged, as desired, either at a slight distance from the forming cylinder 1 or it can be pressed against that cylinder. There is a water collection trough 22 provided for the forming cylinder 1 and located just after the belts 2, 3 separate at roller 21.

In the embodiment shown, the web of paper 23 that is formed is carried along by the outer felt screen 2 and is subsequently delivered by the latter. Instead of this, however, the inner belt 3 (of wire or felt) can also serve to convey the web of paper.

If desired, the concave support surface 16 may be provided with openings 30 for connection to external suction means 31, M for pressure reduction between the concave support surface and the outer strip 2. Where measurement or regulation of the pressure are required, suitable connections 32 and 33 may be made to the surface. In the apparatus of FIG. 1, the concave surface 16 is provided with surface openings connected to the ducts 32 and 33 which may be used for drainage, suction, measurement or regulation.

Figure 2:
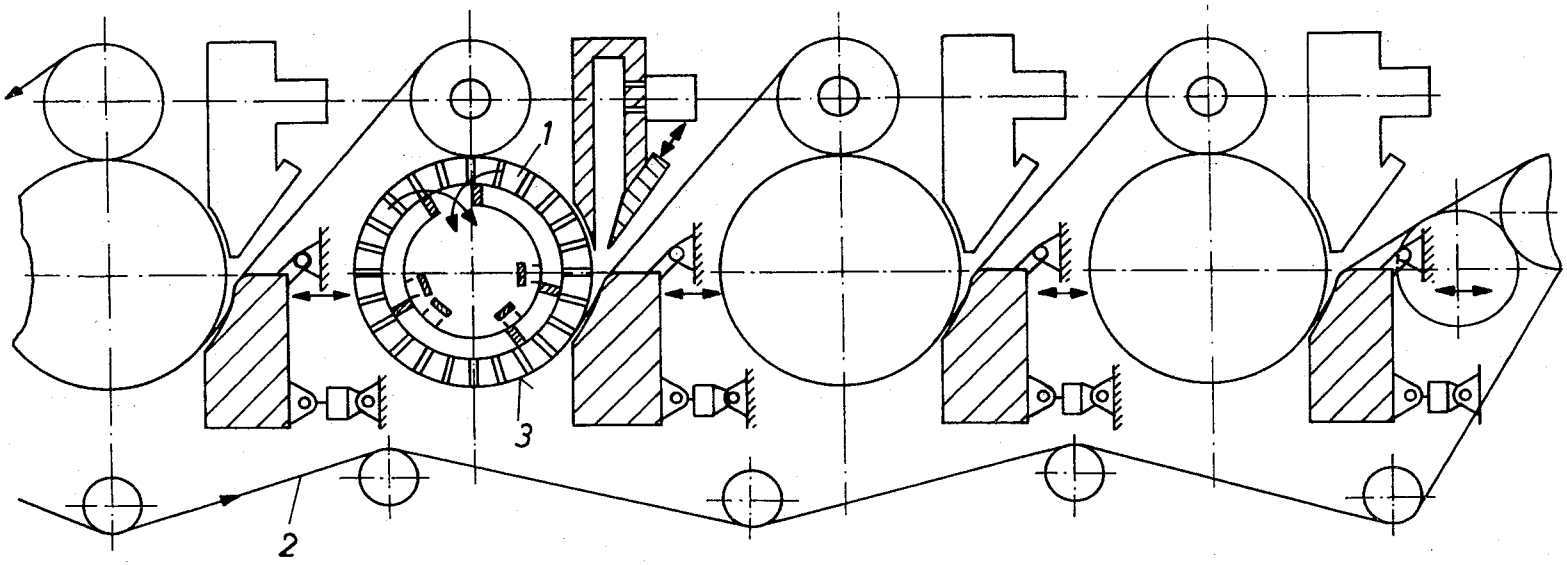
FIG. 2 is the same type of view of a second embodiment.
Figure 3:
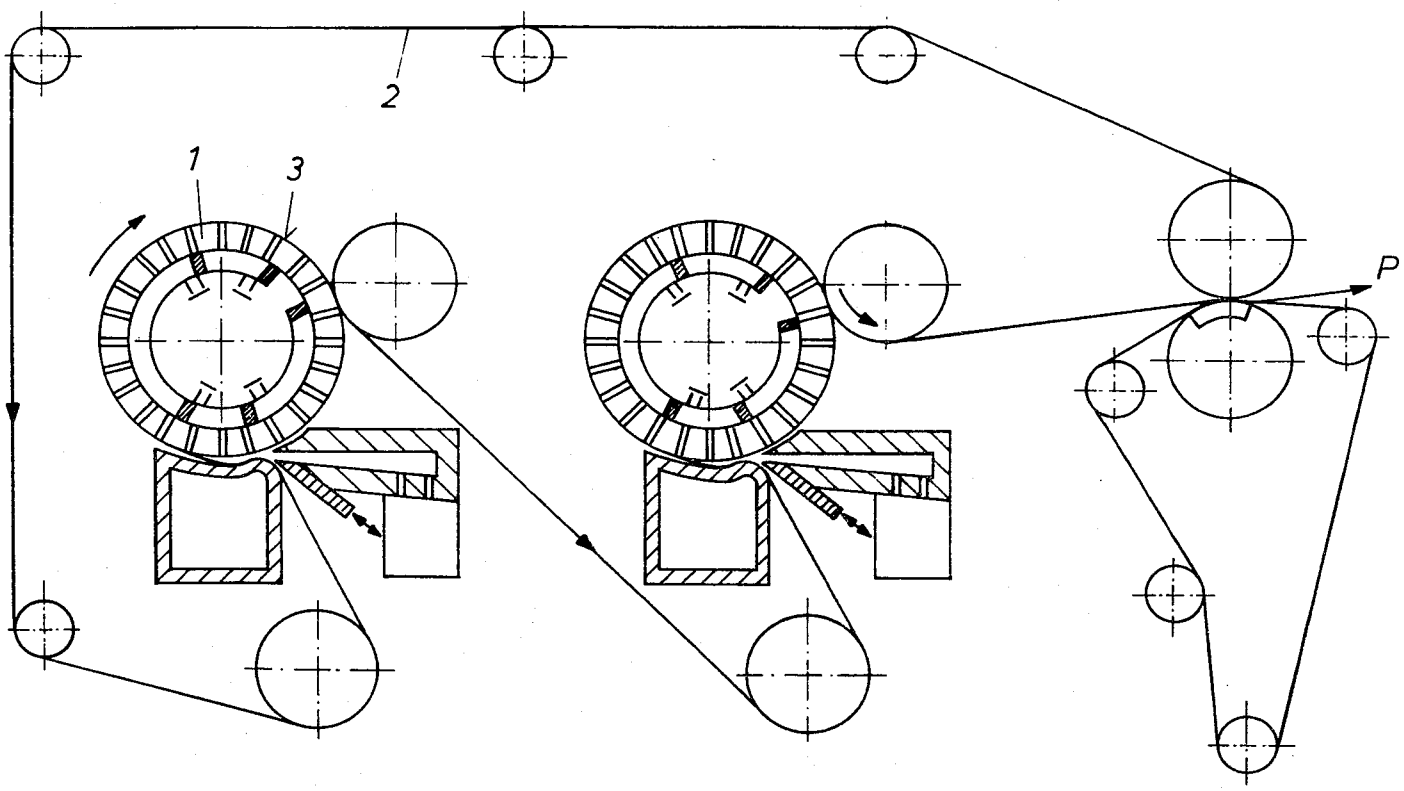
FIG. 3 is the same type of view of a third embodiment.

FIGS. 2 and 3 show alternate embodiments of formers in which the inner belt is a wire-screen casing which completely encircles the forming cylinder. In these two embodiments, so-called cylinder machines, only the main elements have been provided with reference numbers, namely the same reference numbers used in FIG. 1. Here the outer belt is a felt strip. It travels from one forming cylinder to the other. The outer belt thus must fulfill two functions: on the one hand, it serves as a web-forming element (as in the embodiment of FIG. 1), while on the other hand, it transports the individual webs that were formed from one forming cylinder to the other.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A former for a paper machine, comprising:

a rotatable forming cylinder having a peripheral surface;

an inner belt and an outer belt, both being wrapped about said peripheral surface; said belts being so supported with respect to a section of said peripheral surface as to define between said belts a generally wedge-shaped inlet slot;

a nozzle for emitting a fiber suspension of pulp; said nozzle having an outlet opening of the width of said forming cylinder; said nozzle outlet opening being directed into said inlet slot;

a supporting device for said outer belt having the width of said forming cylinder, located downstream of said nozzle and generally at said inlet slot; said supporting device having a concave support surface, which is curved around an axis that is generally parallel to the axis of said forming cylinder, and said concave surface facing toward said outer belt, whereby as said outer belt runs into said inlet slot, said outer belt runs in contact with at least part of said concave surface;

said supporting device having an convex support surface, which is also curved around an axis generally parallel to the axis of said cylinder, and said convex surface facing toward said outer belt and being located upstream of said concave surface with respect to the flow from said nozzle, said convex surface being so placed and said nozzle outlet opening being so placed that fiber suspension emitted from said nozzle is emitted toward said inlet slot in the vicinity of said convex surface, whereby as said outer belt runs into said inlet slot, said outer belt first runs in contact with said convex surface before running in contact with said concave surface; said concave and said convex support surfaces being so placed and shaped that upon said outer belt passing over said convex support surface, said outer belt is held by said convex surface nearer to said forming cylinder peripheral surface and upon said outer belt passing over the portion of said concave surface adjacent to said convex surface, said outer belt is guided by said concave surface further from said forming cylinder peripheral surface.

2. The former of claim 1, wherein said supporting device comprises a cross bar, which extends along an axis generally parallel to the axis of said forming cylinder; and means for adjusting the distance between and the relative angular positions of said forming cylinder and said supporting device.

3. The former of claim 1, wherein said concave surface includes measuring or regulating connections for purposes of pressure measurement or regulation.

4. The former of claim 1, wherein said nozzle and said belts are positioned so that the fiber suspension of pulp is fed to said surface of said cylinder at the lower half of said cylinder.

5. The former of claim 4, wherein said nozzle and said belts are also positioned so that the fiber suspension of pulp is fed to said surface of said cylinder upstream of and above the lowest point of said cylinder.

6. The former of claim 5, wherein said outer belt passes around only part of said cylinder surface and, moving downstream, said outer belt is apart from said cylinder surface upstream of said inlet slot and engages said cylinder surface in the vicinity of said inlet slot.

7. The former of claim 1, wherein said inner belt comprises a peripheral surface around said cylinder and that said surface is perforated.

8. The former of claim 1, wherein both said inner and said outer belts are endless belts.

9. The former of claim 1, wherein said outer belt passes around only part of said cylinder surface and, moving downstream, said outer belt is apart from said cylinder surface upstream of said inlet slot and engages said cylinder surface in the vicinity of said inlet slot.

10. The former of claim 1, wherein said outer belt is of felt.

11. The former of claim 10, wherein said inner belt comprises a peripheral surface around said cylinder and that said surface is perforated.

12. The former of claim 10, wherein said forming cylinder is water permeable.

13. The former of claim 12, further comprising suction means communicating with said concave surface for effecting pressure reduction between said concave surface and said outer belt.

14. The former of claim 13, wherein said suction means comprises openings into said concave surface and connectable to an external suction device.

15. The former of claim 1, wherein said forming cylinder is water permeable.

16. The former of claim 15, further comprising suction means communicating with said cylinder for drawing water from said peripheral surface of said cylinder.

17. The former of claim 16, wherein said inner belt comprises a peripheral surface around said cylinder and that said surface is perforated.

18. The former of claim 16, further comprising second suction means communicating with said concave surface for effecting pressure reduction between said concave surface and said outer belt.

19. The former of claim 18, wherein said second suction means comprises openings into said concave surface and connectable to an external suction device.

20. The former of claim 2, further comprising suction means communicating with said concave surface for effecting pressure reduction between said concave surface and said outer belt.

21. The former of claim 20, wherein said suction means comprises openings into said concave surface and connectable to an external suction device.

22. The former of claim 20, wherein said supporting device comprises a cross bar, which extends along an axis generally parallel to the axis of said forming cylinder; and means for adjusting the distance between and the relative angular positions of saidforming cylinder and said supporting device.

23. The former of claim 22, wherein said concave surface includes measuring or regulating connections for purposes of pressure measurement or regulation.

24. The former of claim 22, wherein said nozzle and said belts are positioned so that the fiber suspension of pulp is fed to said surface of said cylinder at the lower half of said cylinder.

25. The former of claim 24, wherein said outer belt passes around only part of said cylinder surface and, moving downstream, said outer belt is apart from said second cylinder surface upstream of said inlet slot and engages said cylinder surface in the vicinity of said inlet slot.

26. The former of claim 24, wherein said nozzle and said belts are also positioned so that the fiber suspension of pulp is fed to said surface of said cylinder upstream of and above the lowest point of said cylinder.

27. The former of claim 26, wherein said outer belt passes around only part of said cylinder surface and, moving downstream, said outer belt is apart from said second cylinder surface upstream of said inlet slot and engages said cylinder surface in the vicinity of said inlet slot.

28. The former of claim 20, wherein said concave surface includes measuring or regulating connections for purposes of pressure measurement or regulation.

* * * * *